US010900489B2

(12) United States Patent
Rendusara et al.

(10) Patent No.: US 10,900,489 B2
(45) Date of Patent: Jan. 26, 2021

(54) AUTOMATIC PUMPING SYSTEM COMMISSIONING

(71) Applicant: Schlumberger Technology Corporation, Sugar Land, TX (US)

(72) Inventors: Dudi Abdullah Rendusara, Singapore (SG); Roderick Ian MacKay, London (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 148 days.

(21) Appl. No.: 15/035,728

(22) PCT Filed: Nov. 13, 2014

(86) PCT No.: PCT/US2014/065348
§ 371 (c)(1),
(2) Date: May 10, 2016

(87) PCT Pub. No.: WO2015/073606
PCT Pub. Date: May 21, 2015

(65) Prior Publication Data

US 2016/0265323 A1 Sep. 15, 2016

Related U.S. Application Data

(60) Provisional application No. 61/903,948, filed on Nov. 13, 2013.

(51) Int. Cl.
*F04D 13/10* (2006.01)
*F04D 15/00* (2006.01)
(Continued)

(52) U.S. Cl.
CPC ..... *F04D 13/10* (2013.01); *E21B 43/128* (2013.01); *E21B 47/008* (2020.05);
(Continued)

(58) Field of Classification Search
CPC ..... E21B 43/128; E21B 47/008; F04B 47/06; F04B 49/02; F04D 13/086; F04D 15/0066;
(Continued)

(56) References Cited

U.S. PATENT DOCUMENTS 5,563,490 A 10/1996 Kawaguchi et al.
6,467,340 B1 10/2002 Gallagher et al.
(Continued)

FOREIGN PATENT DOCUMENTS

EP 1332276 B1 8/2006

OTHER PUBLICATIONS

PCT/US2014/065348, International Search Report and Written Opinion, dated Mar. 17, 2015, 16 pgs.
(Continued)

*Primary Examiner* — Kenneth J Hansen

(57) ABSTRACT

A technique facilitates automatic commissioning operations on pumping systems, e.g. electric submersible pumping systems. The automatic commissioning technique employs closed-loop monitoring and control processes which may include monitoring of pump shaft direction and speed measurements. In many applications, the technique reduces the time and manual effort otherwise involved in commissioning pumping systems in well completions. Embodiments also may be employed in automated decision-making related to commissioning and in determining operational settings based on sensed environmental and/or well performance conditions.

18 Claims, 2 Drawing Sheets

(51) Int. Cl.
*E21B 47/008* (2012.01)
*E21B 43/12* (2006.01)

(52) U.S. Cl.
CPC ..... *F04D 15/0066* (2013.01); *F04D 15/0077* (2013.01); *F04D 15/0094* (2013.01)

(58) Field of Classification Search
CPC .. F04D 15/0088; F04D 15/0077; F04D 15/02; F04D 15/0094; F04D 13/10
See application file for complete search history.

(56) References Cited

U.S. PATENT DOCUMENTS 6,873,267 B1 3/2005 Tubel et al.
7,305,306 B2 12/2007 Venkataramanan et al.
7,869,978 B2 1/2011 Anderson et al.
8,082,217 B2 12/2011 Crossley et al.
8,527,219 B2 9/2013 Camilleri
8,776,617 B2 7/2014 Durham et al.
9,057,256 B2 6/2015 Ige et al.
2003/0015320 A1 1/2003 Crossley
2004/0244971 A1 12/2004 Shammai et al.
2005/0043921 A1 2/2005 Zhu et al.
2005/0273296 A1 12/2005 Zhu et al.
2007/0071612 A1 3/2007 Yuratich
2008/0066536 A1 3/2008 Goodwin et al.
2008/0093083 A1 4/2008 Johnson
2008/0131295 A1* 6/2008 Koehl ..... F04D 15/0088 417/53
2008/0156486 A1 7/2008 Ciglenec et al.
2008/0187444 A1 8/2008 Molotkov et al.
2008/0236821 A1 10/2008 Fielder
2008/0262736 A1* 10/2008 Thigpen ..... E21B 43/128 702/9
2009/0000789 A1* 1/2009 Leuthen ..... E21B 43/128 166/369
2009/0044938 A1 2/2009 Crossley et al.
2009/0256519 A1 10/2009 Yohanan et al.
2010/0150737 A1 6/2010 Anderson et al.
2011/0033314 A1* 2/2011 Plitt ..... F04B 47/06 417/15
2011/0120703 A1 5/2011 Onodera et al.
2011/0272501 A1 11/2011 Butler
2011/0276187 A1 11/2011 Ciglenec et al.
2012/0065951 A1 3/2012 Roy et al.
2012/0095603 A1 4/2012 Rashid et al.
2012/0325467 A1 12/2012 Lebel et al.
2013/0090853 A1 4/2013 Anderson
2013/0175030 A1 7/2013 Ige et al.
2013/0278183 A1 10/2013 Liang et al.
2014/0094974 A1 4/2014 Rashid
2014/0301869 A1 10/2014 Durham et al.

OTHER PUBLICATIONS

International Preliminary Report on Patentability issued in the PCT Application PCT/US2013/065348, dated May 17, 2016 (12 pages).
Examination Report issued in the GB application 1608330.5, dated Jun. 20, 2016 (1 page).

* cited by examiner

AUTOMATIC PUMPING SYSTEM COMMISSIONING

CROSS-REFERENCE TO RELATED APPLICATIONS

The present document is based on and claims priority to U.S. Provisional Application Ser. No. 61/903,948 filed Nov. 13, 2013, which is incorporated herein by reference in its entirety.

BACKGROUND

Electric submersible pumping systems are used in oil well artificial lift applications to provide pressure for lifting oil to the surface. The electric submersible pumping system is deployed downhole into a well completion located in a wellbore. When the pumping system is first deployed, it is configured by a field engineer using a manual process. The manual process involves various testing and component selection relating to support systems, switchgear systems, and well environment. This process is referred to as "commissioning" the electric submersible pumping system. However, the various testing procedures can incur several startup and shutdown cycles which consume many hours of commissioning time. Such tests also tend to be stressful for the electric submersible pumping system because each startup/shutdown cycle involves operation of the electric submersible pumping system for a period of time without steady-state flow of cooling and lubricating fluid. Consequently, such testing can detrimentally affect the reliability and useful life of the pumping system.

SUMMARY

In general, a system and methodology are provided for automatically performing commissioning operations on pumping systems, such as electric submersible pumping systems. The system and methodology employ closed-loop monitoring and control processes which may include monitoring of pump shaft direction and speed measurements. In many applications, the technique reduces the time and manual effort otherwise involved in commissioning pumping systems in well completions. Embodiments also may be employed in automated decision-making related to commissioning and in determining operational settings based on sensed environmental and/or well performance conditions.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for automatically performing commissioning operations on pumping systems. In many applications, the commissioning technique may be performed on electric submersible pumping systems. The technique enables automated commissioning and may be employed to automatically perform a number of commissioning related operations, e.g. verifying that a downhole pump motor of the pumping system is rotating in the desired direction.

Traditionally, it has been difficult to conclusively determine pump rotation direction other than through a series of time-consuming manual tests. The traditional manual tests tended to involve installing the pumping system, connecting it to switchgear, conducting a first pressure or flow test by starting the pump, increasing the frequency of the variable speed drive system for the pump motor, increasing motor speed, and then measuring the pressure or flow increase in produced oil. Subsequently, the system would be shut down and a second pressure or flow test would be conducted after reconfiguring the three-phase motor power supply by reversing two of the phases. The pumping system would then be restarted, and the procedure repeated to measure the pressure or flow increase in produced oil.

Embodiments of the technique described herein, however, eliminate or reduce the number of startup-shutdown cycles, thus reducing testing time and enhancing the dependability and longevity of the pumping system. In embodiments of the present system and methodology, closed-loop monitoring and control processes are employed. By way of example, the closed-loop monitoring may include monitoring of pump shaft direction and speed measurements via suitable sensors. Furthermore, embodiments described herein may be employed in automated decision-making related to commissioning and in determining operational settings based on sensed environmental and/or well performance conditions.

Figure 1:
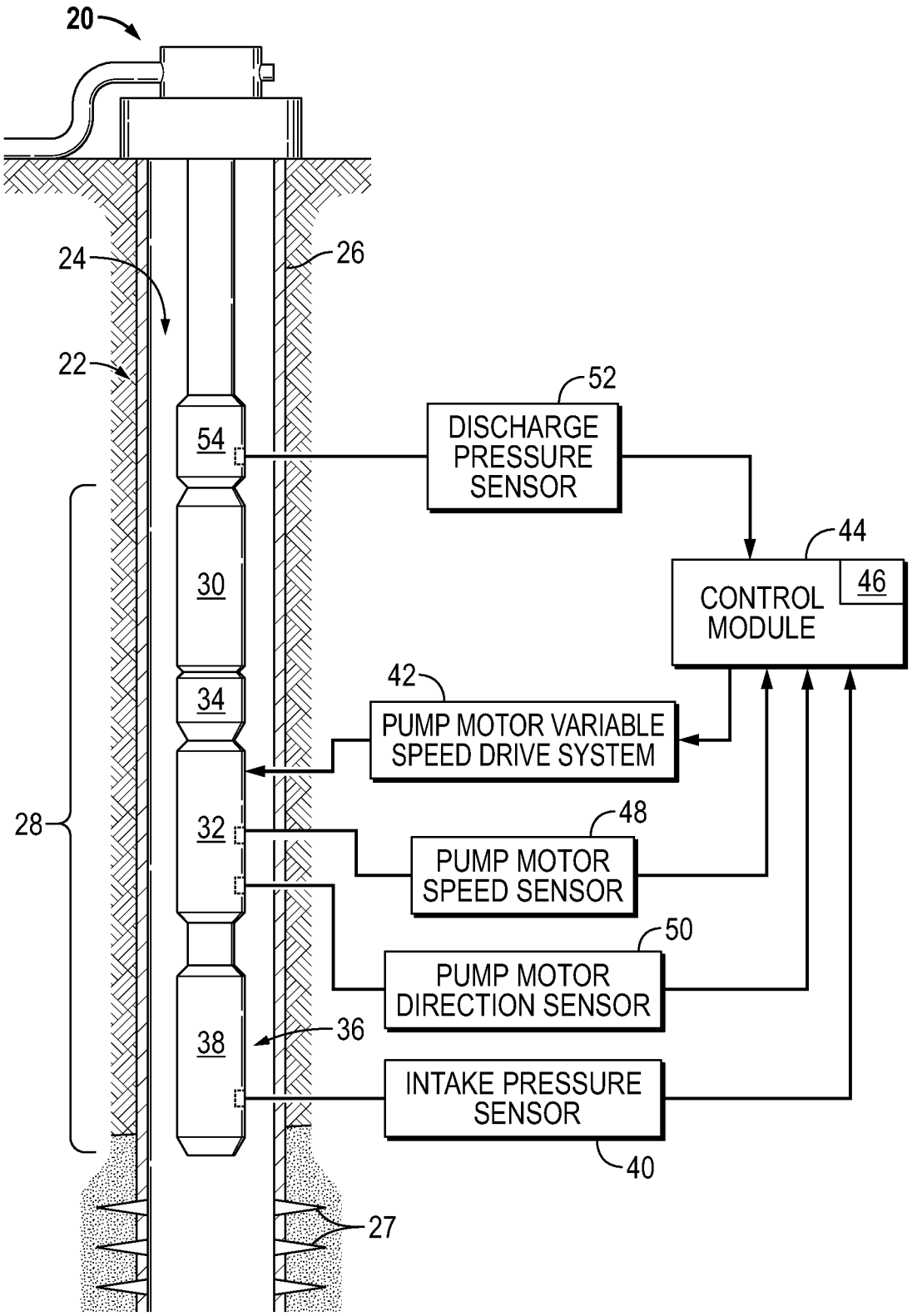
FIG. 1 is an illustration of an example of a well system which utilize an automated commissioning technique, according to an embodiment of the disclosure.

Referring generally to FIG. 1, an example of a well system 20 is illustrated as comprising a wellbore completion 22. The wellbore completion 22 is deployed in a wellbore 24 which may be lined with a casing 26 having perforations 27. In this example, the well system 20 comprises an artificial lift system 28 in the form of an electric submersible pumping system. The electric submersible pumping system 28 may have a variety of components including, for example, a submersible pump 30, a motor 32 to power the submersible pump 30, a motor protector 34, and a sensor system 36 which may include a multisensory gauge 38.

By way of example, the multisensory gauge 38 may be in the form of or comprise elements of the Phoenix Multisensor xt150 Digital Downhole Monitoring System™ for electric submersible pumps and manufactured by Schlumberger Technology Corporation. The multisensory gauge 38 may comprise sensors for monitoring downhole parameters, such as temperature, flow, and pressure. For example, the multisensory gauge 38 may have an intake pressure sensor 40 for measuring an inlet pressure of the electric submersible pumping system 28.

A power source, such as a surface power source may be used to provide electrical power to the downhole components, including power to the submersible motor 32 via a suitable power cable or other conductor. In this example, the motor 32 may be controlled with a variable speed drive (VSD) system 42. An example of the VSD system 42 is described in U.S. Pat. No. 8,527,219. The VSD system 42 may be used to provide a variable frequency signal to motor 32 so as to increase or decrease the motor speed.

The well system 20 also may comprise a controller/control module 44. In some applications, the control module 44 may include surface located control and monitoring equipment which incorporates one or more processing units. The processing units of the control module 44 may be used for various tasks, including executing software application instructions, storing data into a memory 46, and retrieving data from the memory 46. The processing capability of control module 44 also may be used for rapidly and continuously processing signals from various sensors, such as intake pressure sensor 40, a downhole pump motor speed sensor 48, a downhole pump motor direction sensor 50, a discharge pressure sensor 52, and environmental sensors.

Additionally, the control module 44 may be used to output control signals to various pumping system components, such as the pump motor variable speed drive system 42 and a pressure choke valve 54. The signals from the various sensors, e.g. sensors 40, 48, 50, 52, may be conveyed to control module 44 via suitable communication lines, such as a downhole wireline. The control signals output to variable speed drive system 42, pressure choke valve 54, and/or other controlled components may be generated according to suitable control algorithms, models, and/or applications executed by control module 44 to perform automated commissioning procedures on the electric submersible pumping system 28. Examples of the automated commissioning procedures comprise controlling the variable speed drive system 42 and thus the pump motor 32 during a direction determining process as described below with reference to FIG. 2. The control module 44 also may be used for automated decision-making related to commissioning and in determining operational settings based on environmental and/or well performance conditions which are sensed via suitable sensors, such as sensors 40, 48, 50, 52 and/or environmental sensors.

In some applications, the sensor system 36 also may comprise surface instrumentation coupled with the control module 44. The surface instrumentation may be used to aid, for example, an auto commissioning process. According to an embodiment, surface instrumentation is used to measure three-phase voltages and currents (motor currents). The surface instrumentation also may be used to monitor other parameters, such as wellhead pressure if, for example, the downhole sensors do not monitor pump discharge pressure. The surface instrumentation in combination with the downhole gauge 38 and/or other downhole sensors help address issues that may be encountered during the commissioning process. Examples of such issues include issues related to equipment sizing, selection, and operation verification based on, for example, motor nameplate and power consumption. Other issues may be related to power quality, well deliverability, inflow performance, e.g. flow rate estimation, and electric submersible pumping system operating temperature. The combination of surface and downhole instrumentation facilitates monitoring of these parameters during commissioning and enables automatic adjustments via control module 44.

Figure 2:
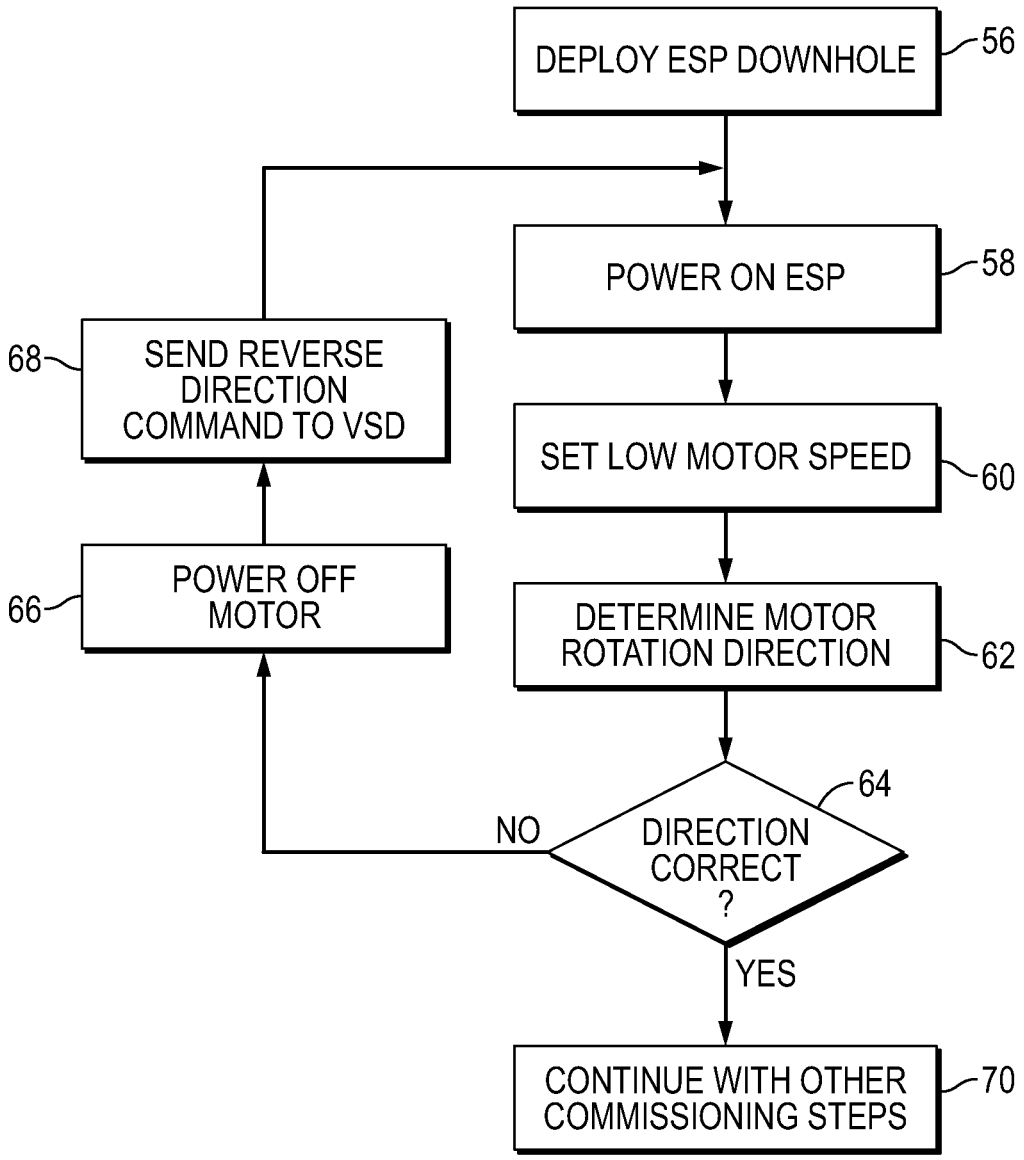
FIG. 2 is a flowchart illustrating an operational example employing the commissioning technique and the well system illustrated in FIG. 1, according to an embodiment of the disclosure.

Referring generally to FIG. 2, a flowchart is used to illustrate an example of a methodology for automatically commissioning an electric submersible pumping system. In this example, the electric submersible pumping system 28 is initially deployed downhole, as represented by block 56. Power is supplied to the electric submersible pumping system 28, e.g. to pump motor 32, via a suitable power cable, as represented by block 58. The control module 44 is then utilized to provide a low motor speed signal to variable speed drive system 42 to prevent undue system stress during the automated commissioning phase, as represented by block 60. By way of example, the low motor speed is set below a motor speed used during normal production of well fluid by the electric submersible pumping system 28. The speed may be monitored via downhole motor speed sensor 48.

Subsequently a determination is made as to motor rotational direction based on sensor data sent to control module 44 from pump motor direction sensor 50, as represented by block 62. At this stage, a decision is made by control module 44 as to whether the pump motor direction of rotation (i.e. the direction of motor shaft rotation) is proper, as represented by decision block 64. If the motor direction is not proper, a control signal is generated by the control module 44 to power off the pump motor 32, as represented by block 66. Then, another control signal is provided by control module 44 in the form of a reverse direction command signal provided to variable speed drive system 42, as represented by block 68. The procedure set forth above in blocks 58, 60, 62 and 64 is then repeated. At this stage, the motor rotation direction should be in the desired direction and the remaining stages of automatic commissioning are continued, as represented by block 70. During the commissioning procedures, the control module 44 receives data from pump motor speed sensor 48 to ensure that a low motor speed is maintained.

In various embodiments of well system 20, control module 44 may be used to continuously processed signals in real-time from the various sensors, e.g. sensors 40, 48, 50, 52, of electric submersible pumping system 28. The continued monitoring of sensor data enables the control module 44 to provide appropriate and automatic control signals to the variable speed drive system 42, pressure choke valve 54, and/or other controlled components of electric submersible pumping system 28. In other words, the control module 44 may be used to provide a closed-loop control of various operating parameters associated with the electric submersible pumping system 28 during commissioning and operation of the pumping system.

By way of example, the closed-loop control provided by control module 44 may comprise obtaining sensor readings for a sensed operating parameter and then determining whether the sensed value is equal to (or within an acceptable range of) a target value. In some applications, the target values may be determined by a well operator. If the sensed value is outside of an acceptable range, the control module 44 may automatically modify control signals to the pump motor variable speed drive system (and/or to other components of the pumping system 28) to bring the operational parameter value back within the acceptable range. The closed-loop control is useful during both the automated commissioning stage and subsequent stages of pumping system operation. Effectively, the automated control procedure reduces the time associated with commissioning of the electric submersible pumping system while increasing pumping system uptime, longevity, and well production.

Depending on the pumping system application and environment, various algorithms, models, and/or applications may be employed by the control module 44 to process data and to provide appropriate corresponding control signals to controlled components of the electric submersible pumping system 28. The control module 44 may comprise a surface control, but it also may comprise other types of controls, including a downhole controller, a server, an office system coupled through a satellite link, and/or a supervisory control and data acquisition (SCADA) system (examples of an SCADA system and other industrial control systems are described in US Patent Publication 2013/0090853).

Depending on the application, the well system 20, wellbore completion 22, and electric submersible pumping system 28 may have a variety of configurations and comprise numerous types of components. Additionally, various sensors and combinations of sensors may be employed. The procedures for obtaining and analyzing the data also may be adjusted according to the parameters of a given well, completion system, and/or reservoir. Similarly, the control module 44 may be programmed to detect various events, trendlines, discontinuities, and/or other changes in the data from individual or plural sensors to determine specific conditions associated with the commissioning and/or operation of the pumping system. Various closed loop control strategies also may be used to continually monitor and adjustably control the commissioning and operation of the pumping system.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

deploying an electric submersible pumping system downhole in a wellbore;

powering the electric submersible pumping system to rotate a motor of the electric submersible pumping system in a first direction;

controlling operation of the motor of the electric submersible pumping system with control signals from a control module to a variable speed drive system;

determining via a downhole sensor whether the first direction of motor rotation is proper, wherein determining whether the first direction of motor rotation is proper occurs while rotating the motor in the first direction, and determining whether the first direction of motor rotation is proper occurs before any change in control signals from the control module to the variable speed drive system; and using the control module to automatically change the direction of motor rotation to a second, opposite direction by sending a reverse direction command to the variable speed drive system from the control module in response to determining that the first direction of motor rotation is improper.

2. The method as recited in claim 1, wherein controlling operation comprises sending the control signals from the control module to a motor variable speed drive.

3. The method as recited in claim 2, wherein using the control module comprises changing the control signals to interrupt power to the motor when automatically changing the direction of motor rotation.

4. The method as recited in claim 3, wherein using the control module comprises changing the control signals to a reverse direction control signal from the control module to the motor variable speed drive after changing the control signals to interrupt power.

5. The method as recited in claim 1, wherein using the control module comprises utilizing a closed-loop control.

6. The method as recited in claim 5, further comprising coupling the control module with a downhole motor speed sensor, an intake pressure sensor, and a discharge pressure sensor.

7. The method as recited in claim 1, further comprising coupling the control module to a pressure choke valve.

8. The method as recited in claim 1, further comprising completing an automated commissioning process based on data obtained from surface instrumentation and downhole sensors, and then operating the electric submersible pumping system in an oil production application.

9. A method, comprising:

deploying an electric submersible pumping system downhole in a wellbore;

powering the electric submersible pumping system;

automatically performing a commissioning operation on the electric submersible pumping system via a control module disposed at a downhole location within the wellbore, wherein automatically performing the commissioning operation comprises:

sending control signals from the control module to a motor of the electric submersible pumping system to rotate the motor in a first direction of rotation;

receiving, at the control module, sensor data from a downhole sensor;

determining, at the control module while rotating the motor in the first direction of rotation without any change in the control signals sent to the motor to rotate the motor in the first direction, whether the first direction of rotation of the motor is a desired direction of rotation based on the sensor data; and sending a reverse direction command from the control module to the motor to reverse the first direction of rotation of the motor to the desired direction of rotation in response to determining that the first direction of rotation is not the desired direction of rotation; and upon successful completion of the commissioning operation, using the electric submersible pumping system in a production application to produce oil.

10. The method as recited in claim 9, wherein automatically performing the commissioning operation comprises using the control module to process sensor data from a downhole motor speed sensor.

11. The method as recited in claim 10, wherein automatically performing the commissioning operation comprises outputting control signals to a motor variable speed drive based on the sensor data.

12. The method as recited in claim 10, wherein automatically performing the commissioning operation comprises outputting control signals to a pressure choke valve based on the sensor data.

13. The method as recited in claim 10, wherein automatically performing the commissioning operation comprises implementing a closed-loop control system.

14. The method as recited in claim 9, further comprising sensing environmental and well performance conditions to enhance at least one of the commissioning operation or production application.

15. The method as recited in claim 14, wherein sensing comprises sensing with a multisensory gauge comprising sensors configured to monitor downhole parameters within the wellbore, wherein the downhole parameters comprise temperature, flow, pressure, or any combination thereof.

16. A system for use in a well, comprising:

an electric submersible pumping system positioned in a wellbore for pumping a fluid;

a variable speed drive system coupled with a motor of the electric submersible pumping system to control a motor speed;

at least one sensor for sensing a parameter related to pumping the fluid; and a downhole control module coupled with the at least one sensor and with the variable speed drive system in a closed-loop control, wherein the downhole control module is disposed at a downhole location within the wellbore, the downhole control module is configured to receive data from the at least one sensor indicating a direction of motor rotation, the downhole control module is configured to determine if an initial direction of motor rotation upon start up is proper while the motor is rotating in the initial direction before any change in operation of the variable speed drive system, and the downhole control module is configured to automatically output a reverse direction command to the variable speed drive system to reverse the direction of motor rotation in response to determining that the direction of motor rotation is improper.

17. The system as recited in claim 16, wherein the downhole control module is a processor-based downhole control module.

18. The system as recited in claim 16, wherein the at least one sensor comprises a plurality of downhole sensors for detecting motor rotation, motor rotational speed, and pressure.

* * * * *